US010112207B2

(12) United States Patent
Paulo

(10) Patent No.: US 10,112,207 B2
(45) Date of Patent: Oct. 30, 2018

(54) MIST GENERATING APPARATUS

(71) Applicant: Toyota Motor Engineering & Manufacturing North America, Inc., Erlanger, KY (US)

(72) Inventor: Robert A. Paulo, Caistor Centre (CA)

(73) Assignee: Toyota Motor Engineering & Manufacturing North America, Inc., Plano, TX (US)

( * ) Notice: Subject to any disclaimer, the term of this patent is extended or adjusted under 35 U.S.C. 154(b) by 0 days.

(21) Appl. No.: 15/339,052

(22) Filed: Oct. 31, 2016

(65) Prior Publication Data

US 2018/0117614 A1 May 3, 2018

(51) Int. Cl.

| | |
|---|---|
| ***B05B 13/02*** | (2006.01) |
| ***B05B 12/12*** | (2006.01) |
| ***B05B 1/34*** | (2006.01) |
| ***B05B 9/01*** | (2006.01) |
| ***B05B 12/02*** | (2006.01) |
| *B05B 13/06* | (2006.01) |

(52) U.S. Cl.

CPC ..... *B05B 12/122* (2013.01); *B05B 1/34* (2013.01); *B05B 9/01* (2013.01); *B05B 12/02* (2013.01); *B05B 13/0278* (2013.01); *B05B 13/0221* (2013.01); *B05B 13/06* (2013.01)

(58) Field of Classification Search

CPC .. B05B 1/34; B05B 9/01; B05B 12/02; B05B 13/0278; B05B 13/0221; B05B 13/06

USPC ..... 427/421.1

See application file for complete search history.

(56) References Cited

U.S. PATENT DOCUMENTS

| | | | | |
|---|---|---|---|---|
| 4,798,341 | A * | 1/1989 | Gimple | B05L 35/03 118/629 |
| 4,993,353 | A * | 2/1991 | Ogasawara | B05L 312/14 118/302 |
| 5,439,608 | A | 8/1995 | Kondrats | |
| 8,658,240 | B2 | 2/2014 | Fritz et al. | |
| 9,169,404 | B2 | 10/2015 | Enghardt et al. | |
| 2009/0090890 | A1 | 4/2009 | Nguyen | |
| 2011/0017848 | A1* | 1/2011 | Keith | A01C 23/008 239/722 |
| 2013/0032213 | A1* | 2/2013 | Borner | B05B 12/085 137/1 |
| 2013/0040373 | A1 | 2/2013 | Weatherman et al. | |
| 2014/0158043 | A1 | 6/2014 | Woodhall et al. | |

(Continued)

*Primary Examiner* — Alexander M Weddle

(74) *Attorney, Agent, or Firm* — Christopher G. Darrow; Darrow Mustafa PC

(57) ABSTRACT

A mist generating apparatus is provided for suppressing foreign material from becoming airborne prior to an application of a surface coat or treatment to a substrate. The assembly includes a frame assembly that may include a base mount and an intermediate mount movably coupled to the base mount. The apparatus includes an extension assembly movably coupled to the frame assembly and selectively positioned between a retracted position and an extended position. A manifold is coupled to the extension assembly, and the manifold is in fluid communication with a volatile liquid. The apparatus includes a spray nozzle in fluid communication with the manifold. The spray nozzle is configured for directing a mist of the volatile liquid to a portion of the substrate for at least temporarily suppressing foreign material.

18 Claims, 6 Drawing Sheets

(56) References Cited

U.S. PATENT DOCUMENTS

| | | | | |
|---|---|---|---|---|
| 2014/0224279 | A1* | 8/2014 | Anderson | B60S 3/04<br>134/18 |
| 2015/0315459 | A1 | 11/2015 | McDaniel et al. | |

* cited by examiner

MIST GENERATING APPARATUS

TECHNICAL FIELD

The present disclosure relates generally to a mist generating apparatus and, more particularly, to systems and methods for suppressing foreign material, such as dust, from becoming airborne prior to an application of a surface coating or treatment to a substrate, such as a vehicle advancing along an assembly line.

BACKGROUND

The background description provided herein is for the purpose of generally, presenting the context of the disclosure. Work of the presently named inventors, to the extent it may be described in this background section, as well as aspects of the description that may not otherwise qualify as prior art at the time of filing, are neither expressly nor impliedly admitted as prior art against the present technology.

Surface cleaning and preparation processes are important considerations of a vehicular assembly processes. In order to attain an effective and aesthetically pleasing finished vehicle surface that also protects against rust and corrosion, an underlying substrate should be effectively free of foreign material including, but not limited to, foreign dust particles, dirt particles, lint, oils and the like during various phases of surface treatment and coating processes. To achieve a suitable, durable substrate surface to which various paints and finishes can adhere, great care is taken such that paint booths and spray-coating booths are clean and dust free. However, if the substrate entering the paint booth is not clean or dust free, there remains a high risk of contamination during the surface treatment or coating process. In certain instances a vehicle assembly, sometimes referred to as a body-in-white, includes various sheet metal components of the vehicle that have been welded together, but most other moving parts have not yet been added. The body-in-white can be subjected to various operations and processes associated with the ultimate vehicle assembly, and various types of foreign material can adhere to the body-in-white as a result of these operations prior to the surface treatment or coating applications.

Various automated mechanical and vacuum surface cleaning processes have been proposed and attempted. However, the various attempts have been met with varying degrees of limited success, either in the effectiveness in the removal of foreign material and/or in the risk of damaging or scarring surfaces of the body-in-white or substrate during surface cleaning operations. Accordingly, there remains a need for an improved way of preventing dust and dirt that may have accumulated on the floor of a vehicle during build processes from becoming airborne in primer, top coat paint, and other surface treatment booths and becoming a defect in the coating finish.

SUMMARY

This section provides a general summary of the disclosure, and is not a comprehensive disclosure of its full scope or all of its features.

In various aspects, the present teachings provide a mist generating apparatus for suppressing foreign material from becoming airborne prior to an application of a surface treatment to a substrate. The mist generating apparatus includes a frame assembly that may include a base mount and an intermediate mount movably coupled to the base mount. The apparatus includes an extension assembly movably coupled to the frame assembly and selectively positioned between a retracted position and an extended position. A manifold is coupled to the extension assembly, and the manifold is in fluid communication with a volatile liquid. The apparatus includes a spray nozzle in fluid communication with the manifold. The spray nozzle is configured for directing a mist of the volatile liquid to a portion of the substrate for, at least temporarily, suppressing foreign material.

In other aspects, the present teachings provide a system for suppressing foreign material from becoming airborne prior to an application of a surface coat or treatment to a vehicle. In various aspects, the vehicle may be moving along an assembly line, prior to an application of a paint, primer, base coat, or the like. The system may include a first mist generating apparatus and a second mist generating apparatus. Each mist generating apparatus may include a frame assembly, and an extension assembly movably coupled to the frame assembly and selectively positioned between a retracted position and an extended position. A manifold may be provided, coupled to the extension assembly. The manifold may be in fluid communication with a volatile liquid. Each apparatus may include a spray nozzle in fluid communication with the respective manifold. The spray nozzle may be configured for directing a mist of the volatile liquid. The system may further include a controller configured to direct the respective extension assemblies of the first and second mist generating apparatuses into the extended position and, in turn, position the respective spray nozzles into first and second interior portions of the vehicle when the vehicle is positioned adjacent the mist generating apparatuses. The controller may also be configured to control an amount of volatile liquid expelled from each spray nozzle.

In still other aspects, the present teachings provide a method for suppressing foreign material from becoming airborne prior to an application of a surface coating or treatment to a vehicle. The method may include advancing a vehicle along an assembly line and into, or adjacent to, a surface coating or treatment application area. The method may include coordinating an extension of at least one spray nozzle of a misting apparatus into an interior portion of the vehicle. Once in an appropriate location, the method may include actuating the at least one spray nozzle for a predetermined duration of time, and directing a mist of a volatile liquid in a downward direction with respect to the interior portion of the vehicle, such that the mist suppresses foreign material from becoming airborne. The method may include retracting the at least one spray nozzle from the interior portion of the vehicle after the predetermined duration of time. In still other aspects, the method includes the use of a system that includes coordinating an extension of two spray nozzles configured to be spaced apart within first and second portions of the interior of the vehicle. In this regard, the method may include actuating the two spray nozzles using a programmable logic controller configured to select the predetermined duration of time based on a geometry and dimensions of the interior of the vehicle. In certain aspects, the method may continue with applying a surface coating or treatment to at least a portion of the vehicle.

Further areas of applicability and various methods of enhancing the above technology will become apparent from the description provided herein. The description and specific examples in this summary are intended for purposes of illustration only and are not intended to limit the scope of the present disclosure.

BRIEF DESCRIPTION OF THE DRAWINGS

The present teachings will become more fully understood from the detailed description and the accompanying drawings, wherein.

It should be noted that the figures set forth herein are intended to exemplify the general characteristics of the methods and devices among those of the present technology, for the purpose of the description of certain aspects. These figures may not precisely reflect the characteristics of any given aspect, and are not necessarily intended to define or limit specific embodiments within the scope of this technology. Further, certain aspects may incorporate features from a combination of figures.

DETAILED DESCRIPTION

The present technology generally provides a mist generating apparatus, which may also be referred to as a "cabin mister," and associated methods for suppressing foreign material from becoming airborne prior to an application of a surface treatment to a substrate. In various aspects, the substrate may be a vehicle, or portion of a vehicle. In one example, the vehicle may be moving along an assembly line and may be approaching a partially or fully enclosed structure such as a paint or spray booth, prior to an application of a paint, primer, base coat, or the like. More specifically, the mist generating apparatus may spray a fine mist of a volatile liquid into an interior portion of the vehicle cabin to prevent or minimize dust and dirt that may have accumulated on the floor of the vehicle during build processes from becoming airborne. The mist generating apparatus may include an adjustable frame assembly that can include a base mount and an intermediate mount movably coupled to the base mount. The apparatus may include an extension assembly movably coupled to the frame assembly and selectively positioned between a compact, resting/retracted position and an extended position configured to apply a mist generating procedure. A manifold may be coupled to the extension assembly, and the manifold is in fluid communication with a supply of volatile liquid and pressurized air. The apparatus includes at least one spray nozzle in fluid communication with the manifold. The spray nozzle is configured for directing a mist of the volatile liquid to a portion of the substrate, in one example an interior cabin of a vehicle or vehicle frame, for at least temporarily suppressing foreign material from becoming airborne and potentially interfering with the application of the surface treatment.

Figure 1B:
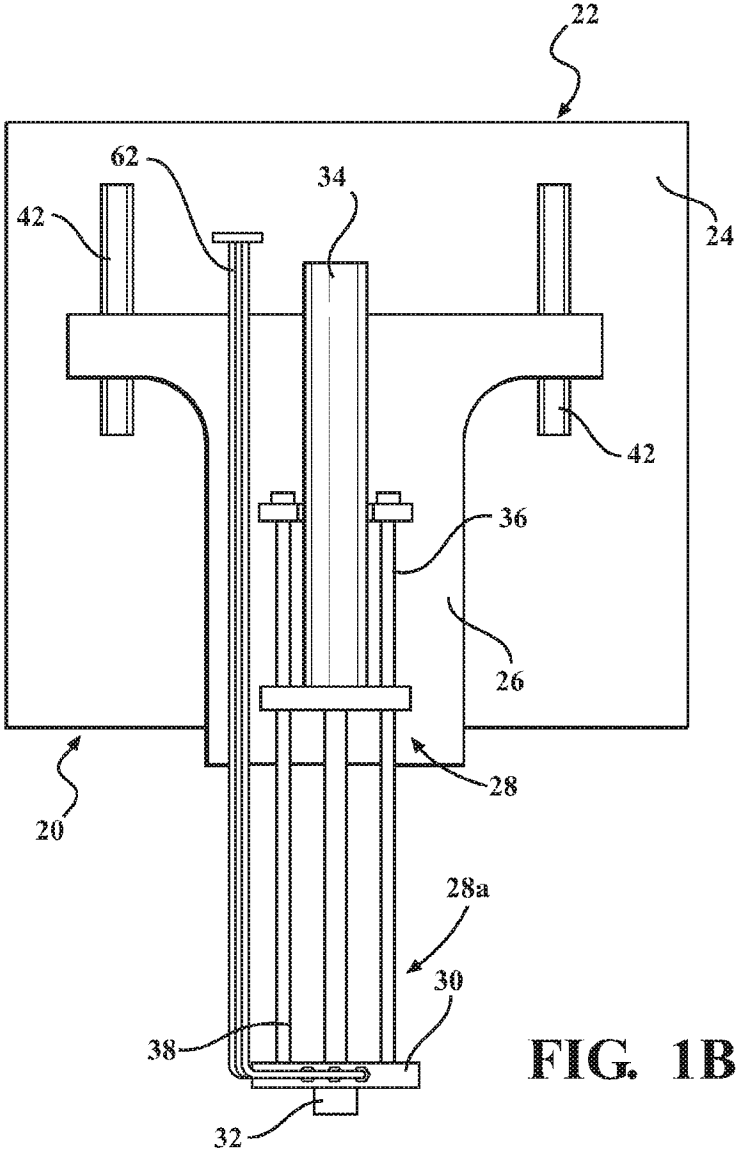
FIG. 1B is a top plan view of a mist generating apparatus useful with the teachings of the present disclosure in an extended state.
Figure 1A:
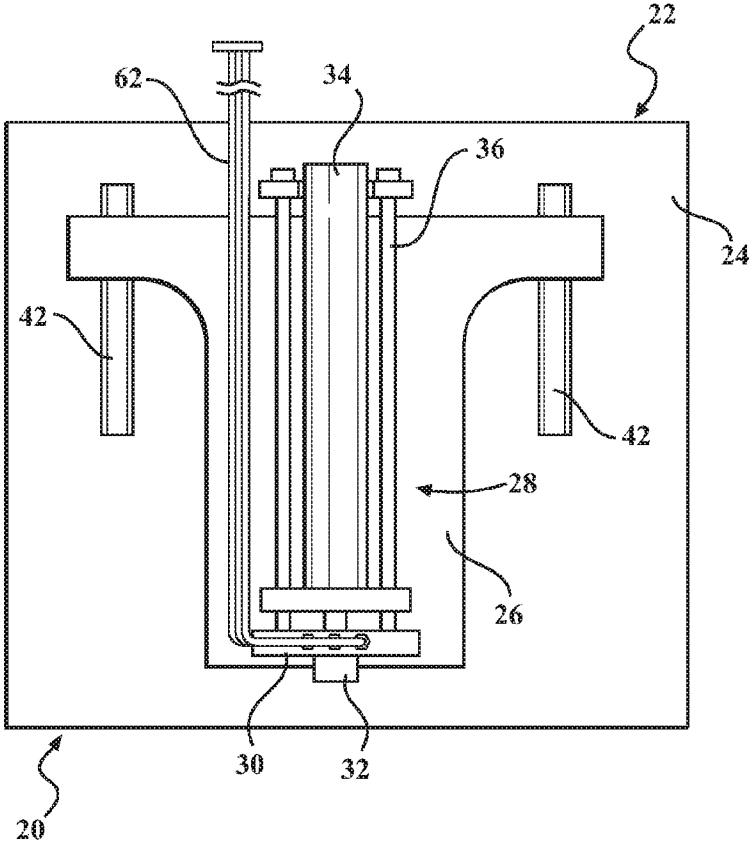
FIG. 1A is a top plan view of a mist generating apparatus useful with the teachings of the present disclosure in a retracted state.
Figure 2:
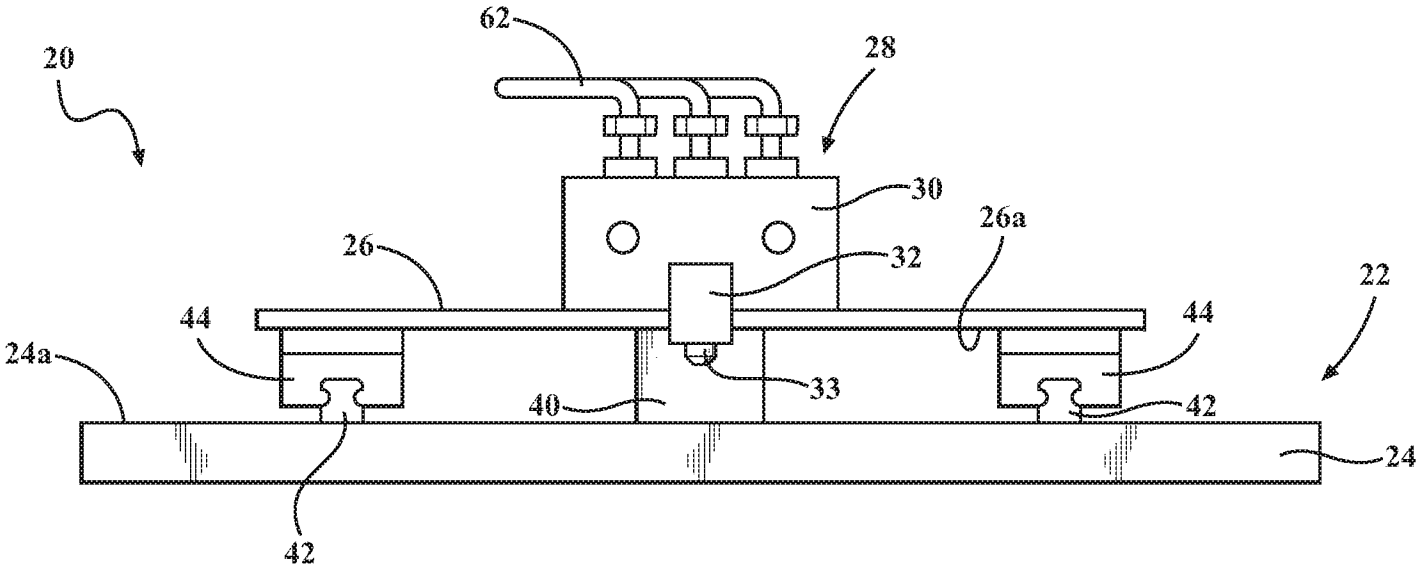
FIG. 2 is a side plan view of the mist generating apparatus of FIG. 1A.
Figure 3:
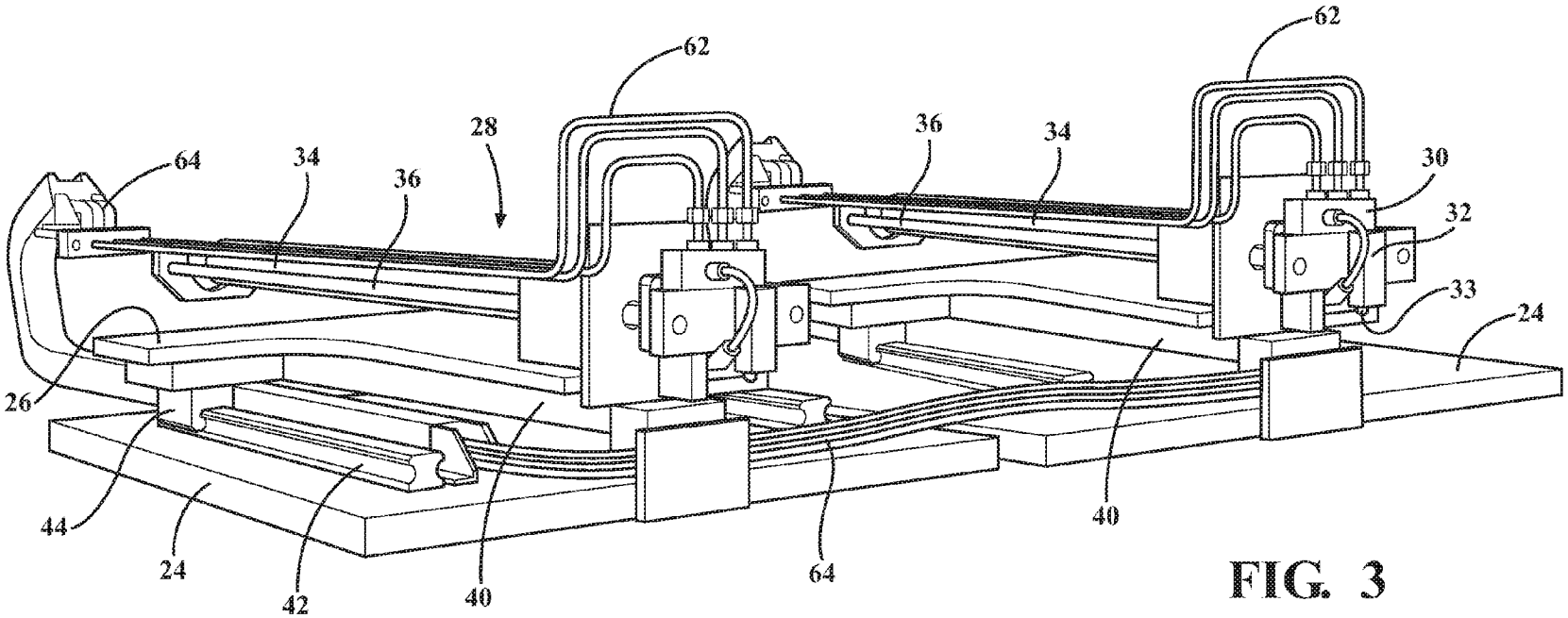
FIG. 3 is perspective view of two mist generating apparatuses of FIG. 1A.

The present technology will be more fully understood with reference to the figures. FIGS. 1A and 1B illustrate a top plan view of a mist generating apparatus 20 according to one aspect useful with the various teachings provided within the present disclosure. FIG. 1A illustrates the resting state of the apparatus 20; FIG. 1B illustrates an extended state of the apparatus 20. FIG. 2 provides a side profile, or side plan view, of the mist generating apparatus 20 of FIG. 1A, and FIG. 3 provides a perspective view of a system, or pair of mist generating apparatuses of FIG. 1A. As shown, the apparatus 20 includes a frame assembly 22 that may include a base mount 24 coupled to an intermediate mount 26. It should be understood that the relative size and shape of the frame assembly 20 and its components may vary as necessary or otherwise desired. The frame assembly 22 may be provided with legs (not shown) or may be placed on, integral with, or otherwise coupled to, a suitable support member, such as a table or the like that may be bolted or otherwise secured to the floor or an area adjacent a paint booth. In various aspects, the frame assembly 22 may be placed on a support surface or support member that ultimately provides for an adjustable or variable height. In this regard, the mist generating apparatus 20 would be operable for use with various substrates, and more specifically, various sizes and types of vehicles, and vehicles with openings at various heights. Thus the present technology provides an apparatus 20 that is easily adapted to vehicle model changes.

In the example shown in FIGS. 1-3, the base mount 24 may be planar and substantially square or rectangular in shape, and the intermediate mount 26 may be shaped or dimensioned as necessary to support the additional components of the mist generating apparatus 20, as will be discussed in more detail below. The materials suitable for use as components for the apparatus 20 should preferably exhibit relatively high strength, be corrosion resistant, and be easily cleaned. Non-limiting, examples of metals include aluminum and stainless steel. High strength plastics, hybrid materials, and composite materials may also be useful. In one aspect, the base mount 24 may be an aluminum plate having a substantially uniform thickness of about 1 inch, for providing adequate support of the various components making up the apparatus 20. The intermediate mount 26 may also be aluminum, movably coupled to the base mount 24 in a substantially parallel manner, and have a similar substantially uniform thickness. Because the intermediate mount 26 will preferably be configured such that it is movable and/or slidable with respect to the base mount 24, it may be provided with a decreased relative thickness, such as between about ¼ inch to about ¾ inch, or about ½ inch. In this regard, the intermediate mount 26 would have enough strength for its purpose, but have less weight relative to the base mount 24. In other certain aspects, stainless steel could be used for various components of the frame assembly 22, as well as for other components of the mist generating apparatus 20.

Figure 5:
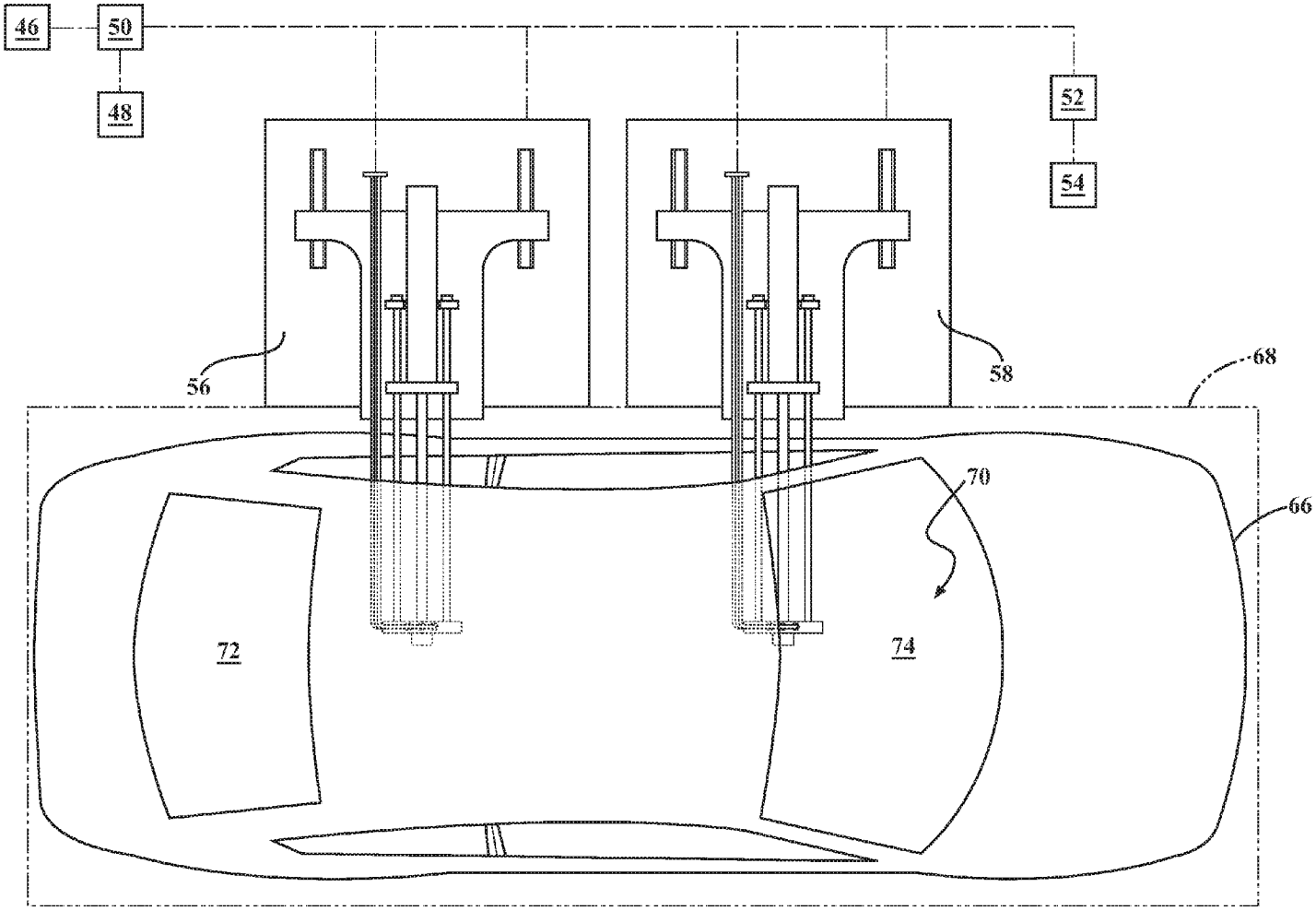
FIG. 5 is a schematic view of the system of FIG. 4 with the mist generating apparatuses in an extended state.

With renewed reference to FIG. 1, the mist generating apparatus 20 may be provided with an extension assembly 28 that may be movably coupled to the frame assembly 22. For example, an extension assembly 28 that is movable between a first, or retracted position, and a second, or extended position. It is also contemplated that the extension assembly 28 can be fixed at any other intermediate location between the retracted position and a fully extended position. When used to suppress foreign material within a vehicle frame assembly (as best shown in FIG. 5), the extension assembly 28 may be configured to extend through a window area of a vehicle door, allowing access to an interior portion of the vehicle cabin, By using a system including two mist generating apparatuses, the extension member 28 of a first apparatus can be inserted through a front door window, while the extension member 28 of a second apparatus can be inserted through a rear door window of the vehicle so that the entire vehicle cabin can receive the mist.

A manifold 30 may be coupled to one end 28*a* of the extension assembly 28. The manifold 30 will ultimately be in fluid communication with a source 46 of a volatile liquid and a source 48 of compressed air, as will be discussed in more detail below. At least one spray gun, or spray nozzle 32, is provided in fluid communication with the manifold 30. For ease of design, it may be preferable that the spray nozzle 32 is stationary, such that it is not movable with respect to the manifold 30. In this regard, the opening 33 of the spray nozzle 32 may be directed in a downward direction such that, when expelled, a fine mist is directed to a floor area of a vehicle cabin, for example, in a downward direction that may exhibit a fan shaped pattern. Nozzle shapes, sizes, and flow rates can be selected so that complete substrate coverage, in one example complete or substantially complete floor coverage of a vehicle interior cabin, can be accomplished using one or two stationary spray nozzles 32. By keeping the spray nozzles 32 in a stationary position during the mist generating procedure, this eliminates any need to swivel or rotate the components, which reduces the number of moving parts that may otherwise increase complexity and cost, and could even potentially introduce more contaminants into the vehicle cabin interior.

In various aspects, the volatile liquid used to create the fine mist is an evaporative liquid, such as water, that may serve as a wetting agent for loose particulates. In aspects where water is used, the water may be filtered, deionized, or otherwise treated depending on the initial quality of the water from its source, and depending on the surface treatment that will ultimately be used with the substrate. Where desirable, other liquids with a relatively higher vapor pressure (as compared to the vapor pressure water at 20° C.), or that are volatile or evaporate fairly quickly at room temperature, may be used, including alcohols, organic solvents, surfactants, and mixtures thereof. In various aspects, the volatile liquid may be provided at or about ambient or room temperature. Preferably, the mist will be applied in an amount such that there is no puddling on the substrate, but at the same time, there is no immediate evaporation of an entirety of the liquid. The droplets from the mist preferably adhere to particulate matter that could be offending to the surface treatment, and at least temporarily suppresses the matter. In various aspects, the application of the mist does not deposit any additional residue, for example, originating from the volatile liquid itself.

In various aspects, the flow of the volatile liquid used for the creation of the mist can be adjusted using one or more external regulator 50. The regulator 50 can adjust liquid flow pressure and/or air flow into the 30 manifold, and ultimately out of the spray nozzle 32, with various predetermined settings configured to provide optimal mist coverage without unwanted puddling or excess liquid collecting on the substrate, such as on the floor of the vehicle interior cabin. In various aspects, a spray time duration can be controlled using a programmable logic controller 52 (PLC) in order to control an amount of volatile liquid expelled from each spray nozzle during a mist generating procedure. For example, the PLC 52 may include various predetermined duration settings that may be based on a geometry and or dimensions of the specific vehicle cabin interior. Similarly, the PLC 52 may include various predetermined pressure settings for the mist generation. Such data can be preloaded for various different vehicles or substrates, and can take into account various heights of the vehicle, or vehicle openings, and preferred heights of the spray nozzles 32 with respect to the substrate geometry. In still other aspects, the interior of the vehicle cabin may be separated into zones, regions, or portions. In this regard, if the vehicle is separated by first and second interior portions, then the amount of volatile liquid expelled from each spray nozzle 32 may be based on different spray time durations and/or pressures, predetermined by the PLC 52, based on respective dimensions of first and second interior portions of the vehicle. In further aspects, it is also contemplated that manual and override settings may be used as necessary.

Figure 4:
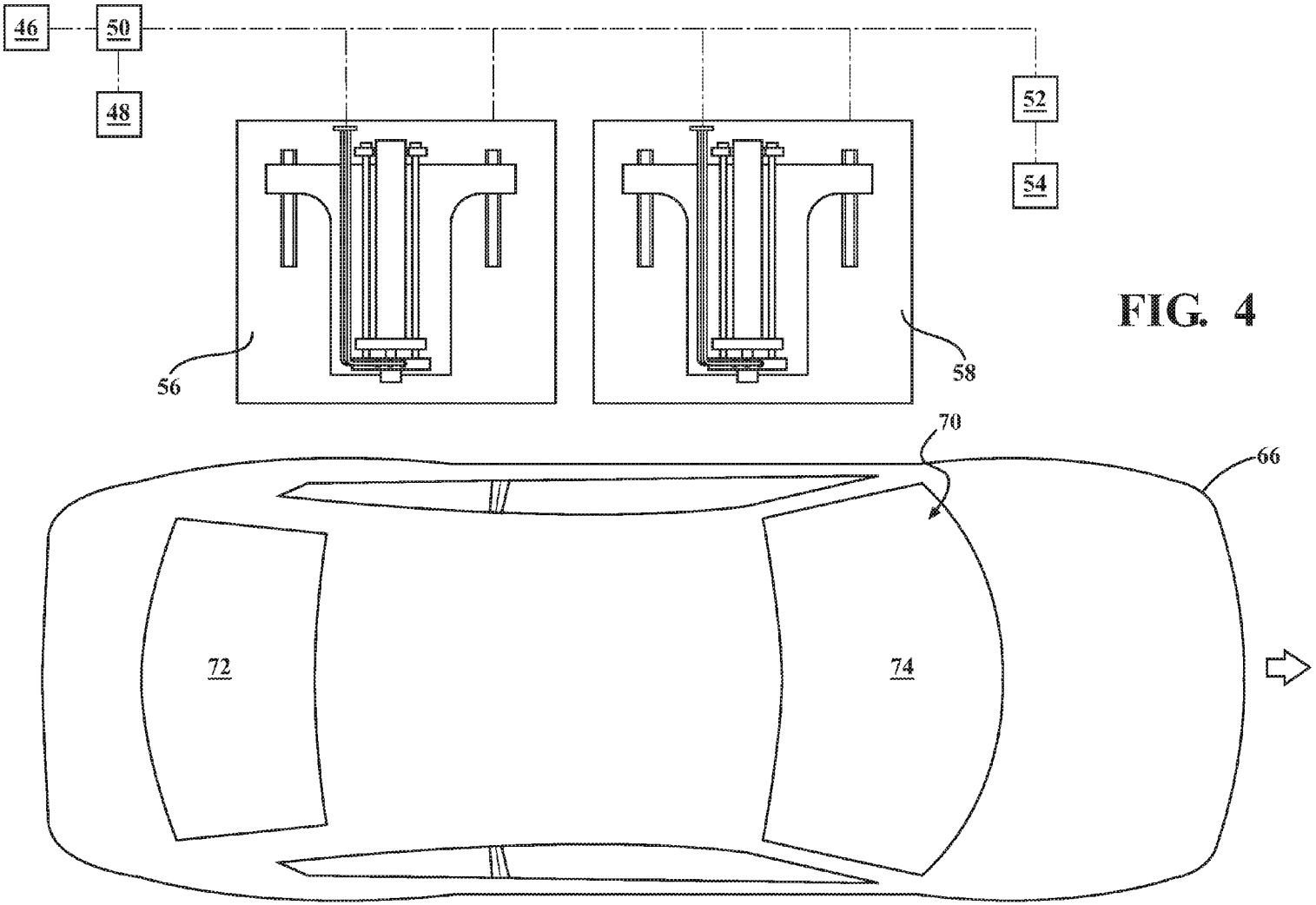
FIG. 4 is a schematic view of a system using a pair of mist generating apparatuses according to another aspect of the present disclosure.

The extension assembly 28 may include one or more mechanisms that will serve to facilitate a transition between the retracted position and the extended position, as well as other transitional positions. In the example shown, an upper pneumatic cylinder 34 may be provided, with one or more elongated guide rods 36. The manifold 30 may be coupled to an end 38 of the guide rods 36 for coordinated movement therewith. Similarly, the frame assembly 22 may include one or more mechanisms that will serve to facilitate relative movement of the intermediate mount 26 with respect to the base mount 24. The movement of the intermediate mount 26 may provide a further reach of the extension assembly 28, and ultimately the manifold 30 and spray nozzle 32, in the vehicle cabin. In the example shown, a lower pneumatic cylinder 40 may be provided to coordinate a sliding movement of the frame assembly 22. In this regard, linear guide rails 42 may be provided on an upper surface 24a of the base mount 24 of the frame assembly 22, and tracks 44 with appropriate bearing assemblies may be provided on a lower surface 26a of the intermediate mount 26 of the frame assembly 22. It should be understood that other configurations, such as tracks and wheels, may also be used. The mist generating apparatus 20 may be coupled to one or more controllers 54, as shown in FIGS. 4-5, that may be configured to direct the respective extension assemblies 28, between the retracted position and the extended position, as well as to intermediate positions there between. Such controllers 54 can be separate from, or integral with, the PLC 52 and regulator(s) 50 used to control the mist generation.

In general, pneumatic or air cylinders are devices that use air pressure to put air into linear motion, such as in an air compressor. A typical air cylinder may include a rod and piston that coordinates the operation the air cylinder. A rodless air cylinder does not have a rod outside of the cylinder. Instead, a piston may be connected to a carriage inside the cylinder. Non-limiting examples of airless rod cylinders that may be useful with the present teachings may include band cylinders, cable cylinders, magnetically coupled air cylinders, and pneumatic cylinders. Although various combinations are contemplated, in certain aspects, the upper cylinder 34 may be an air cylinder with guide rods, and the lower cylinder 40 may be a rodless cylinder.

A band cylinder includes a cylinder carriage and the piston assembly inside the cylinder barrel. There may also be top and inner sealers that prevent air leakage. As compressed air enters the cylinder, it pushes the piston along inside the cylinder. As the cylinder operates, the seals keep the air inside so it can create linear motion. Cable cylinders are a type of rodless air cylinder that uses a cable which attaches to the piston inside the cylinder. Cable cylinders use an end cap that helps prevent the leakage of air from within the cylinder. A cable cylinder also has a pulley that travels through the end cap and around the carriage. As the piston moves inside the cylinder, the carriage moves along the cable to give motion to an object. There are also rodless air cylinders that do not use mechanical means to connect the piston and carriage. One example of such a cylinder is called a magnetic coupling cylinder. In this type of air cylinder, both the carriage and the piston contain magnets that attract each other. As compressed air moves the piston inside the air cylinder, the magnetic attraction moves the carriage along the cylinder barrel. Rodless air cylinders, no matter the type, generally rely on the weight and size of the load they are moving for power.

Figure 6:
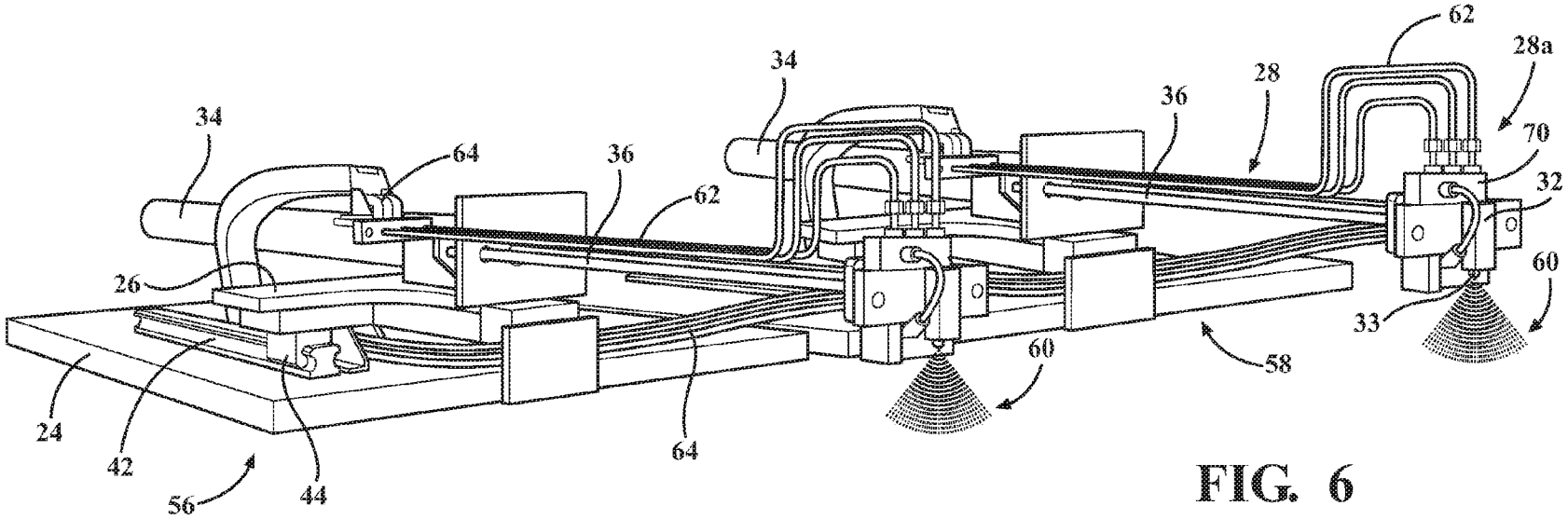
FIG. 6 is an alternate perspective view illustrating the system of he mist generating apparatuses in an extended state during a misting operation.

FIG. 4 is a schematic view of a system that utilizes a pair of first and second mist generating apparatuses 56, 58 according to another aspect of the present disclosure. FIG. 4 illustrates the pair of mist generating apparatuses 56, 58with the extension members 28 in the resting position, while FIG. 5 is a schematic view of the system of FIG. 4 with the extension members 28 in an extended position when the apparatuses 56, 58 are in an active state. FIG. 6 is an alternate perspective view illustrating the system of FIG. 3 with the mist generating apparatuses in the active state, and expelling a mist 60 in a downward direction within an interior of a vehicle cabin.

The mist generating apparatuses 20 may be provided with various supply lines to provide the volatile fluid and air pressure from their respective supplies to the manifolds 30, and can include a combination of stainless steel tubes and flexible conduits. The stainless steel tubes 62 may be used for areas that may extend adjacent the substrate, while flexible conduits 64 (FIG. 6) may be bundled together and coupled to flexible tracks in areas that will not extend near the substrate.

In still other aspects, the present teachings provide methods for suppressing foreign material from becoming airborne prior to an application of a surface coating or treatment to a vehicle. With reference to FIGS. 4-5, the method may include advancing a vehicle 66 along an assembly line and into, or adjacent to, a surface coating or treatment application area 68. The extension members 28 may remain in the retracted position when there is no vehicle present.

When the vehicle 66 is subsequently in position, as shown in FIG. 5, the pneumatic cylinders 34, 40 extend outward in a direction toward the vehicle 66 in order to place the spray nozzles 32 in a respective center area of the interior portions 72, 74 of the vehicle cabin 70. The methods may use various controllers for detecting the presence of the vehicle, coordinating an extension of at least one spray nozzle 32 of a misting apparatus into an interior portion of the vehicle, and actuating the mist generating procedure. Once in an appropriate location, the methods may include actuating the at least one spray nozzle for a predetermined duration of time, and directing a mist of a volatile liquid in a downward direction with respect to the interior portion of the vehicle, such that the mist suppresses foreign material from becoming airborne. The methods may then include retracting the at least one spray nozzle from the interior portion of the vehicle after a predetermined duration of time of the mist generating procedure. In still other aspects, the methods include the use of a system that includes coordinating an extension of two spray nozzles configured to be spaced apart within first and second portions of the interior of the vehicle. In this regard, the methods may include actuating the two spray nozzles using a programmable logic controller configured to select the predetermined duration of time based on a geometry and dimensions of the interior of the vehicle. In certain aspects, the method may then continue with applying a surface coating or treatment to at least a portion of the vehicle.

In various aspects, the mist generating apparatus and use of the methods and. technology described herein results in a reduction of at least about 55% in an amount of air borne particles above 5 microns, as well as exhibiting a dirt pick-up (DPU) reduction of at least about 3.5%.

The foregoing description is provided for purposes of illustration and description and is in no way intended to limit the disclosure, its application, or uses. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations should not be regarded as a departure from the disclosure, and all such modifications are intended to be included within the scope of the disclosure.

As used herein, the term "vehicle" should be construed having a broad meaning, and should include all types of vehicles, with non-limiting examples including a passenger car, truck, motorcycle, off-road vehicle, bus, boat, airplane, helicopter, lawn mower, recreational vehicle, amusement park vehicle, farm vehicle, construction vehicle, train, golf cart, train, or trolley, etc.

As used herein, the phrase at least one of A, B, and C should be construed to mean a logical (A or B or C), using a non-exclusive logical "or." It should be understood that the various steps within a method may be executed in different order without altering the principles of the present disclosure. Disclosure of ranges includes disclosure of all ranges and subdivided ranges within the entire range, including the endpoints.

The headings (such as "Background" and "Summary") and sub-headings used herein are intended only for general organization of topics within the present disclosure, and are not intended to limit the disclosure of the technology or any aspect thereof. The recitation of multiple embodiments having stated features is not intended to exclude other embodiments having additional features, or other embodiments incorporating different combinations of the stated features.

As used herein, the terms "comprise" and "include" and their variants are intended to be non-limiting, such that recitation of items in succession or a list is not to the exclusion of other like items that may also be useful in the devices and methods of this technology. Similarly, the terms "can" and "may" and their variants are intended to he non-limiting, such that recitation that an embodiment can or may comprise certain elements or features does not exclude other embodiments of the present technology that do not contain those elements or features.

The broad teachings of the present disclosure can be implemented in a variety of forms. Therefore, while this disclosure includes particular examples, the true scope of the disclosure should not be so limited since other modifications will become apparent to the skilled practitioner upon a study of the specification and the following claims. Reference herein to one aspect, or various aspects means that a particular feature, structure, or characteristic described in connection with an embodiment or particular system is included in at least one embodiment or aspect. The appearances of the phrase "in one aspect" (or variations thereof) are not necessarily referring to the same aspect or embodiment. It should be also understood that the various method steps discussed herein do not have to be carried out in the same order as depicted, and not each method step is required in each aspect or embodiment.

What is claimed is:

1. A mist generating apparatus for suppressing foreign material from becoming airborne prior to an application of a surface coating or treatment to a substrate, the apparatus comprising:

a frame assembly;

an extension assembly comprising at least one guide rod, the extension assembly being movably coupled to the frame assembly and selectively positioned between a retracted position and an extended position;

a manifold coupled to the guide rod of the extension assembly, the manifold being in fluid communication with a volatile liquid;

a spray nozzle in fluid communication with the manifold, the spray nozzle being configured for directing a mist of the volatile liquid to a portion of the substrate for suppressing foreign material.

2. The mist generating apparatus according to claim 1, wherein the frame assembly comprises a base mount and an intermediate mount, the intermediate mount being substantially parallel with and movably coupled to the base mount.

3. The mist generating apparatus according to claim 2, wherein the extension assembly is movably coupled to the intermediate mount.

4. The mist generating apparatus according to claim 3, wherein the extension assembly further comprises a first pneumatic cylinder.

5. The mist generating apparatus according to claim 4, further comprising a second pneumatic cylinder configured to selectively move the intermediate mount with respect to the base mount.

6. The mist generating apparatus according to claim 2, further comprising at least one linear guide rail assembly slidably coupling the intermediate mount to the base mount.

7. The mist generating apparatus according to claim 2, wherein the base mount comprises an aluminum plate.

8. The mist generating apparatus according to claim 1, further comprising a programmable logic controller configured to control an amount of volatile liquid expelled from the spray nozzle based on a geometry and dimensions of the substrate.

9. The mist generating apparatus according to claim 8, wherein the amount of volatile liquid expelled from the spray nozzle is based on a spray time duration determined by the programmable logic controller.

10. The mist generating apparatus according to claim 1, further comprising a combination of stainless steel and flexible supply lines coupled to the manifold.

11. A system for suppressing foreign material from becoming airborne prior to an application of a surface coating or treatment to a vehicle, the system comprising:

a first mist generating apparatus and a second mist generating apparatus, each mist generating apparatus comprising:

a frame assembly comprising a base mount and an intermediate mount movably coupled to the base mount;

an extension assembly comprising at least one guide rod, the extension assembly being movably coupled to the intermediate mount of the frame assembly and selectively positioned between a retracted position and an extended position;

a manifold coupled to the guide rod of the extension assembly, the manifold being in fluid communication with a volatile liquid; and a spray nozzle in fluid communication with the manifold, the spray nozzle being configured for directing a mist of the volatile liquid;

a controller configured to:

direct the respective extension assemblies of the first and second mist generating apparatuses into the extended position and, in turn, position the respective spray nozzles into first and second interior portions of the vehicle when the vehicle is positioned adjacent the mist generating apparatuses; and control an amount of volatile liquid expelled from each spray nozzle during a mist generating procedure.

12. The system according to claim 11, wherein:

each spray nozzle remains in a stationary position with respect to the manifold during the mist generating procedure; and the amount of volatile liquid expelled from each spray nozzle is based on a spray time duration predetermined by a programmable logic controller, and based on respective dimensions of the first and second interior portions of the vehicle.

13. The system according to claim 11, wherein the base mount and the intermediate mount are substantially parallel.

14. The system according to claim 13, wherein the extension assembly comprises a first pneumatic cylinder.

15. The system according to claim 14, further comprising a second pneumatic cylinder configured to selectively move the intermediate mount with respect to the base mount.

16. The system according to claim 11, further comprising a linear guide rail assembly slidably coupling the intermediate mount to the base mount of each mist generating apparatus.

17. The system according to claim 11, further comprising a combination of stainless steel and flexible supply lines coupled to each manifold.

18. A mist generating apparatus for suppressing foreign material from becoming airborne prior to an application of a surface coating or treatment to a substrate, the apparatus comprising:

a frame assembly comprising a base mount and an intermediate mount, the intermediate mount being substantially parallel with and movably coupled to the base mount;

an extension assembly comprising at least one guide rod, the extension assembly being movably coupled to the intermediate mount of the frame assembly and selectively positioned between a retracted position and an extended position;

a manifold coupled to the guide rod of the extension assembly, the manifold being in fluid communication with a volatile liquid;

a spray nozzle in fluid communication with the manifold, the spray nozzle being configured for directing a mist of the volatile liquid to a portion of the substrate for suppressing foreign material.

* * * * *